US005816696A

United States Patent [19]

Beisler

[11] Patent Number: 5,816,696

[45] Date of Patent: Oct. 6, 1998

[54] ILLUMINATED DISPLAY HOOK

[76] Inventor: Edward J. Beisler, 5 Lark La., Montvale, N.J. 07645

[21] Appl. No.: 722,791

[22] Filed: Sep. 27, 1996

[51] Int. Cl.[6] ..... F21V 21/00

[52] U.S. Cl. ..... 362/396; 362/145; 362/191; 362/234; 362/432

[58] Field of Search ..... 362/147, 190, 362/191, 253, 370, 396, 432, 145, 234; 248/220.22, 220.31, 220.41

[56] References Cited

U.S. PATENT DOCUMENTS

| | | | |
|---|---|---|---|
| 1,130,191 | 3/1915 | O'Brien | 362/410 |
| 2,699,492 | 1/1955 | Cookenboo | 362/396 |
| 4,042,816 | 8/1977 | Smoot | 362/432 |
| 4,533,983 | 8/1985 | Hafstad | 362/432 |
| 4,747,025 | 5/1988 | Barton | 362/147 |
| 5,065,290 | 11/1991 | Makar et al. | 362/191 |

*Primary Examiner*—Alan Cariaso
*Attorney, Agent, or Firm*—Woodbridge & Associates

[57] ABSTRACT

A display hook includes a light at its free end to call attention to the merchandise attached to the hook. The hook includes a base for attachment to a perforated board, a shaft attached to the base, a light located near the free end of the shaft and an energy source for providing power to the light. A pair of studs in the base are selectively engageable in the apertures of the board. Batteries, or an electrical power source, located near the base or at the end of the hook or remote from the hook provide power to the light.

5 Claims, 5 Drawing Sheets

ILLUMINATED DISPLAY HOOK

BACKGROUND OF THE INVENTION

1. Field of the Invention

The invention relates to merchandise display hooks having a light at or near their free end to call attention to the merchandise on the hook.

2. Description of Related Art

The use of hooks removably mounted on display panels is known for the purpose of supporting objects in home workshops and in commercial environments. Such display panels often include openings for receiving mating fixtures on the hooks. One popular type of panel includes a perforated board (Peg Board) for receiving studs that are part of the hooks. Another type of display panel has horizontal slots (Slatwall) that receive angular flanges on the hooks. The use of such display panels and hooks as merchandise racks for the purpose of displaying and making available consumer products in commercial environments is also known. The following U.S. Patent references are typical of such devices: U.S. Pat. Nos. 4,783,033; 4,850,557; 4,665,639 and 4,750,698.

Also, the use of light to call attention to displays, whether racks or not, is also known. See, for example, U.S. Pat. Nos. 4,276,705 and 4,165,576.

Electric light wall fixtures, which have a superficial similarity to the present invention are also, of course, known. Many include a wall mounting base, an arm including conductors and a source of light, or illumination, at the distal end. None can, however, be readily mounted on perforated board or the like. For that matter, the prior art with regard to ordinary wall mounted fixtures considerably predates the wide use of perforated board as a mounting medium. The following U.S. patents appear to be generally relevant to the state of the art of traditional, wall mounted, electric light fixtures: U.S. Pat. Nos. 1,361,426; 1,364,419; 1,627,944; 1,631,997; 1,637,463; 1,780,847; and, 2,298,554.

The use of perforated board is fairly well known as a mechanism for supporting tools and the like in the home. It is less commonly used in retail contexts. The following patents are typical, but not necessarily exhaustive, examples of hooks and the like that can be attached to perforated panel boards: United Kingdom patent specification 792,253 published Mar. 26, 1958 and U.S. Pat. No. 4,319,730 issued Mar. 16, 1982.

Lastly, there presently exist coupon dispensing devices, frequently seen in supermarkets, that include a flashing LED, or the like, to attract a customer to take a merchandise coupon.

One of the major problems with the foregoing prior art is that the illumination of the display is generally of the entire display and it does not call attention to any specific item. For example, if the retailer wanted to call attention to a special price markdown on a particular item on a hook, an illumination of the entire display would not effectively serve that purpose. Accordingly, a need exists for display systems that call attention to specific items on specific hooks rather than on all hooks at the same time. It is also desirable to find a relatively inexpensive, interchangeable means for accomplishing this result and which can be mounted on common perforated board having evenly spaced, study receiving, apertures. The present invention fulfills this need.

SUMMARY OF THE INVENTION

Briefly described, the invention comprises display hooks of the sort that are attachable to a display panel such as a perforated display backboard having evenly spaced, stud receiving, apertures, and which includes at or near its free end a light source such as an LED. In one embodiment, the hook includes a base having a housing on which two studs are mounted that are adapted to engage the evenly spaced apertures in the perforated surface of the display backboard. Of course, alternative attaching means such as a flange and slot may also be used. A shaft, which may or may not be curved, is attached at one end to the base and is capped at the other end by the light source. Batteries, located in the housing, are attached to the light source by a pair of wires which run internally along the length of the shaft. An ON/OFF switch mounted on the base is used to turn the apparatus on and off. Additional electronics may be added to the housing to cause the light to blink or oscillate in such a fashion as to call special attention to the merchandise on the hook.

In another embodiment, the display hook includes two shafts joined to a base. One shaft is provided for holding the merchandise, while the other shaft includes means for mounting a self-contained light source. In this case, the light source is part of a power pack having batteries and other optional electronics mounted in a housing which has a means for mounting the housing on the shaft. It is noted that in another embodiment, the power source is remote from the hook itself and is connected to the light source through conductive studs in the base that are electrically coupled to terminals that form a part of the rack.

The exact nature of this invention as well as other objects and advantages thereof will be readily apparent from consideration of the following specification relating to the annexed drawing.

DETAILED DESCRIPTION OF THE PREFERRED EMBODIMENTS

During the course of this description, like numbers will be used to identify like elements according to the different views that illustrate the invention.

Figure 1:
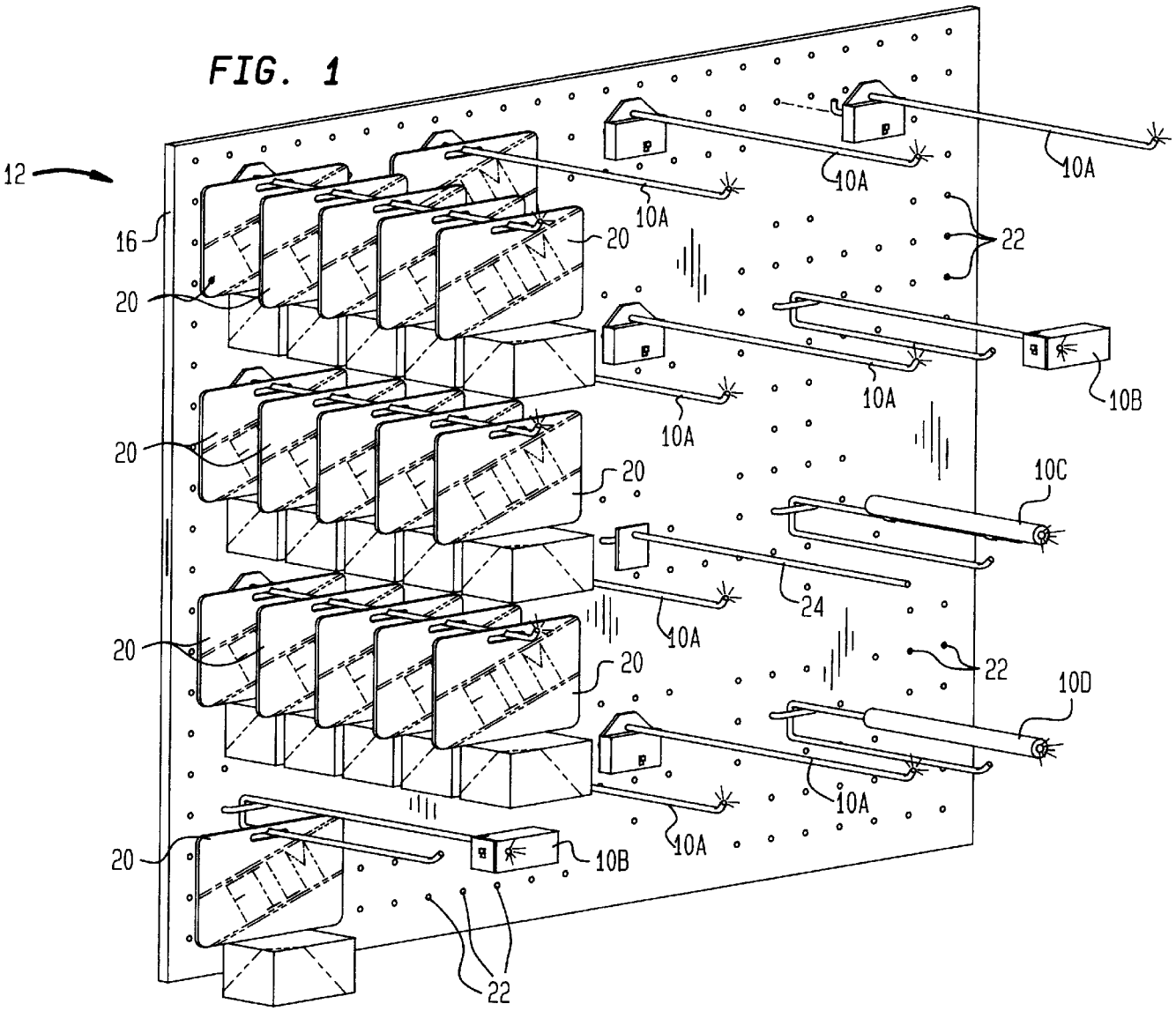
FIG. 1 is a pictorial view showing several embodiments of the invention in a display environment.

A plurality of illuminated display hooks 10*a*–10*d*, according to the preferred embodiment of the invention, are shown in the context of a typical rack display 12 in FIG. 1. Rack display 12 includes a conventional perforated backboard 16 having a plurality of substantially round apertures 22 therein adapted to engage hooks 10*a*–10*d*. Display merchandise 20 is normally attached to hooks 10*a*–10*d* by slipping a hole in the merchandise onto the hooks 10*a*–10*d*. Such displays 12 are typically resupplied on a regular basis by individuals known as "rackers." The display 12 also can also accommodate a conventional non-illuminated hook such as hook 24 in addition to the illuminated display hooks 10*a*–10*d*.

It is to be understood that the display hooks 10*a*–10*d* of the present invention are shown in the context of a perforated board-type display panel for illustration purposes only. Those having ordinary skill in these arts will recognize that other types of well known display panels may be employed. For example, the invention will work equally as well with display panels as described above.

Figure 2:
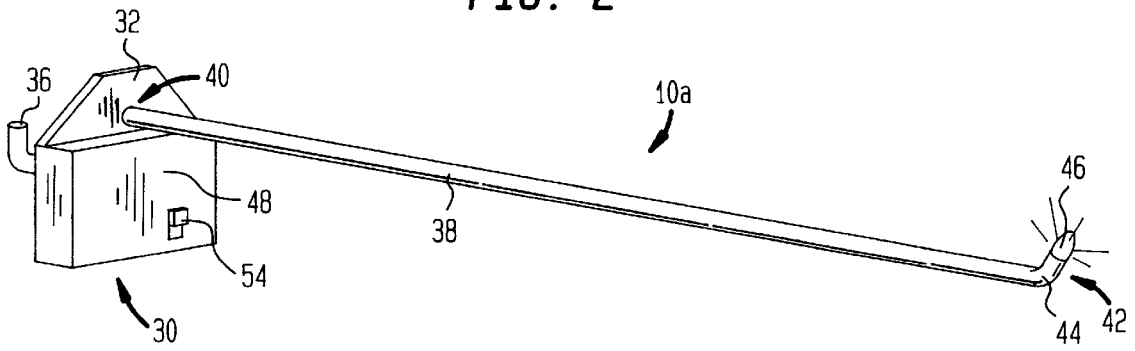
FIG. 2 is a pictorial view of a preferred embodiment of the invention.
Figure 3:
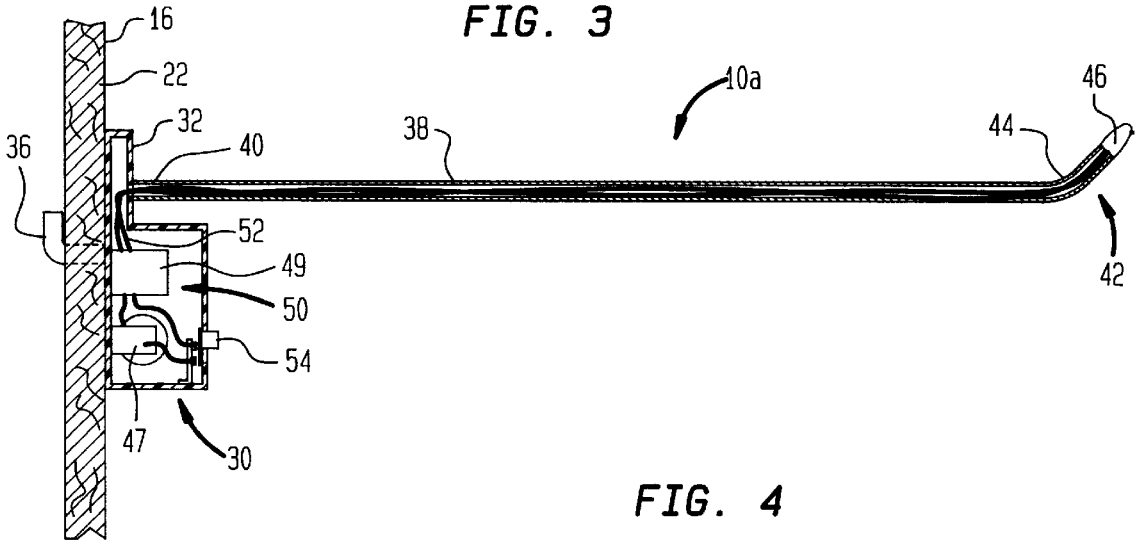
FIG. 3 is a side elevation in section of the device shown in FIG. 2.

As shown in FIGS. 2 and 3, the illuminated display hook 10*a*, according to the preferred embodiment of the invention, essentially comprises a base 30, a shaft 38 attached at one end 40 to the base 30, and a light 46 attached to the free end 42 of the shaft 38. The base 30 includes a housing 48 with two curved studs 36 extending from the back surface thereof for engagement in the conventional manner with adjacent, evenly spaced, apertures 22 in the perforated backboard panel 16. The two studs 36 are curved to engage the back surface of the backboard 16 to keep the hook 10*a* coupled to apertures 22. Shaft 38 is generally straight and includes a curve 44 near the free or distal end 42. The curve 44 is provided to prevent the merchandise 20 from inadvertently slipping off the shaft 38.

Shaft 38 might be straight, or include a curve 44 or might be some other complex form. However, the shape of the shaft 38 must be such so that when it is attached to the base 30 it prevents the merchandise 20 from slipping off the shaft 38.

The housing 48 has mounted therein a battery 47, an on-off switch 54 and an electronic package 49 (e.g., a chip) having conventional signal conditioning circuits. The shaft 38 is hollow for accommodating a pair of conductors 52 that extend from the package 49 to the light source 46.

Figure 4:
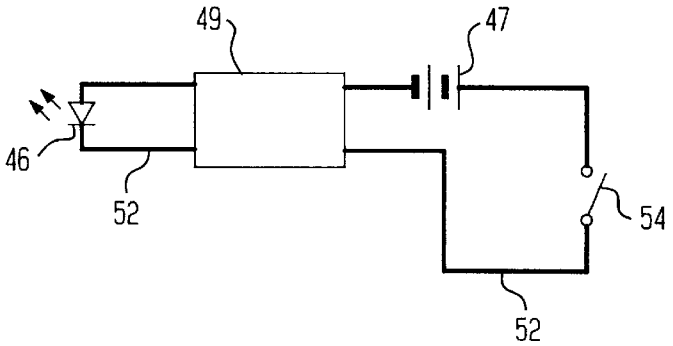
FIG. 4 is a schematic diagram of a circuit for use with the device of FIGS. 2 and 3.

FIG. 4. schematically illustrates the electrical circuit. The battery 47 is connected to the electronic package 49 via on-off switch 54. The package 49 can contain a conventional oscillator for causing light source 46 to pulse or blink. The light source 46 may be a light emitting diode (LED) as shown or any other conventional light source.

Figure 5:
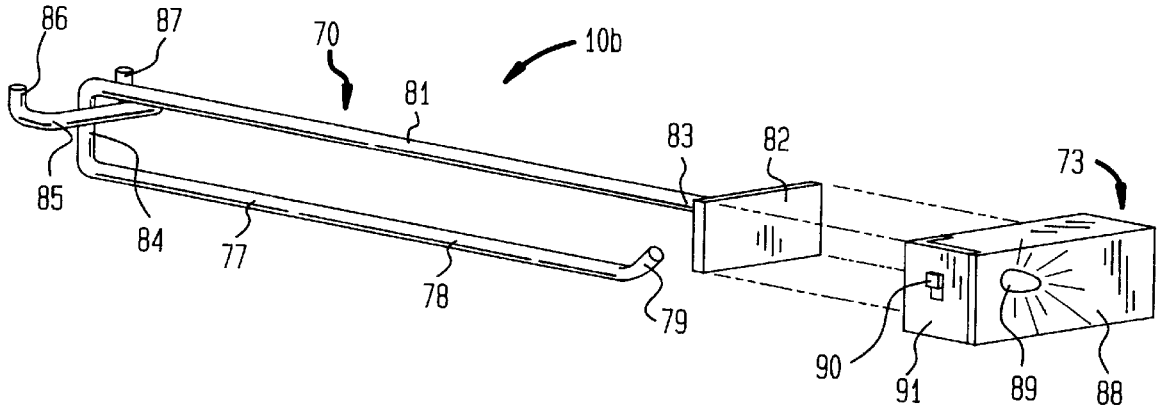
FIGS. 5–7 are pictorial views of alternate embodiments of the present invention.
Figure 6:
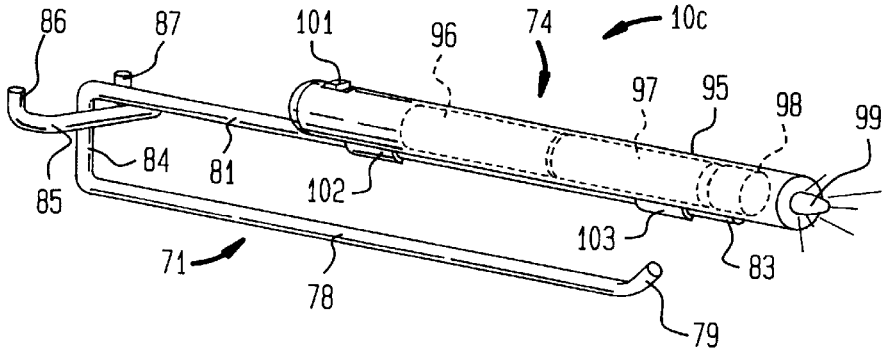
Figure 7:
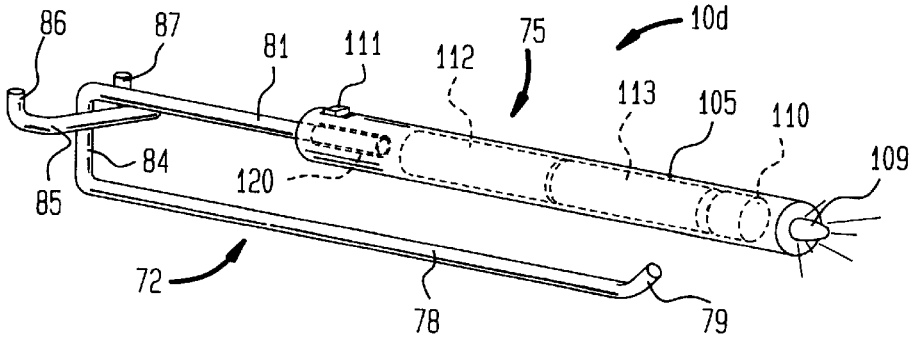

The entire circuit shown in FIG. 4, including the light source 46, may also be mounted in a common housing to provide a self-contained display illuminator. FIGS. 5–7 illustrate three different embodiments of illuminated display hooks 10*b*–10*d* that are formed from conventional type display hooks 70, 71 and 72 and self-contained display illuminators 73, 74 and 75, respectively.

Display hook 70 includes a U-shaped body member 77 having a lower shaft 78 with a curved free end 79. Body member 77 also includes an upper shaft 81 that extends generally parallel to shaft 78. A flat mounting plate 82 is welded or otherwise attached to the free end 83 of shaft 81. Shafts 78 and 81 are attached to the free end 83 of shaft 81. Shafts 78 and 81 are attached at their fixed ends by a vertical shaft 84 that in turn is joined to a stud assembly 85 having curved studs 86, 87 for attachment of the illuminated display hook 10*b* to a pair of adjacent apertures 22 in backboard 16.

The self-contained display illuminator 73 includes a housing 88 having a light source 89 extending from the front fact thereof. A removable side wall 91 has an on-off switch 90 extending therefrom. A circuit similar to the one shown in FIG. 4 is mounted in the housing 88. It is noted that the front face of housing 88 has a broad surface on which an advertising message, a logo or other indicia may be inscribed. The side wall 91 is removable to permit serving the circuit and battery replacement. The back wall of housing 88 is attached by an adhesive to the mounting plate 82.

FIG. 6 illustrates another type of self-contained illuminated display hook 10*c*. Self-contained illuminated hook 10*c* includes a display hook 71 that is similar to display hook 70 in all respects except that the plate 82 is removed. The self-contained display illuminator 74 (FIG. 6) includes a cylindrical housing 95 that contains a pair of batteries 96, 97, an electronic package 98, a light source 99 and an on-off switch 101. A pair of compression mounting clips 102, 103 are attached to the side of housing 95. The clips 102, 103 are a compressed fit onto shaft 81 to frictionally hold the illuminator 74 in the position shown in FIG. 6, i.e, with the light source 99 directed toward the front.

Still another modified embodiment is the illuminated display hook 10*d* of FIG. 7. Hood 10*d* differs from hook 10*c* primarily in the means for mounting the illuminator 75 on the hook 72. The shaft 81 in hook 72 is foreshortened to accommodate a mounting slot 120 formed at the rear end of the housing 105 of illuminator 75. The mounting slot 120, made to frictionally fit onto shaft 81, can also be secured to shaft 81 with an adhesive. The housing 105 contains a pair of batteries 112, 113, an on-off switch 111, an electronic package 110 and a light source 109.

Figures 8, 9:
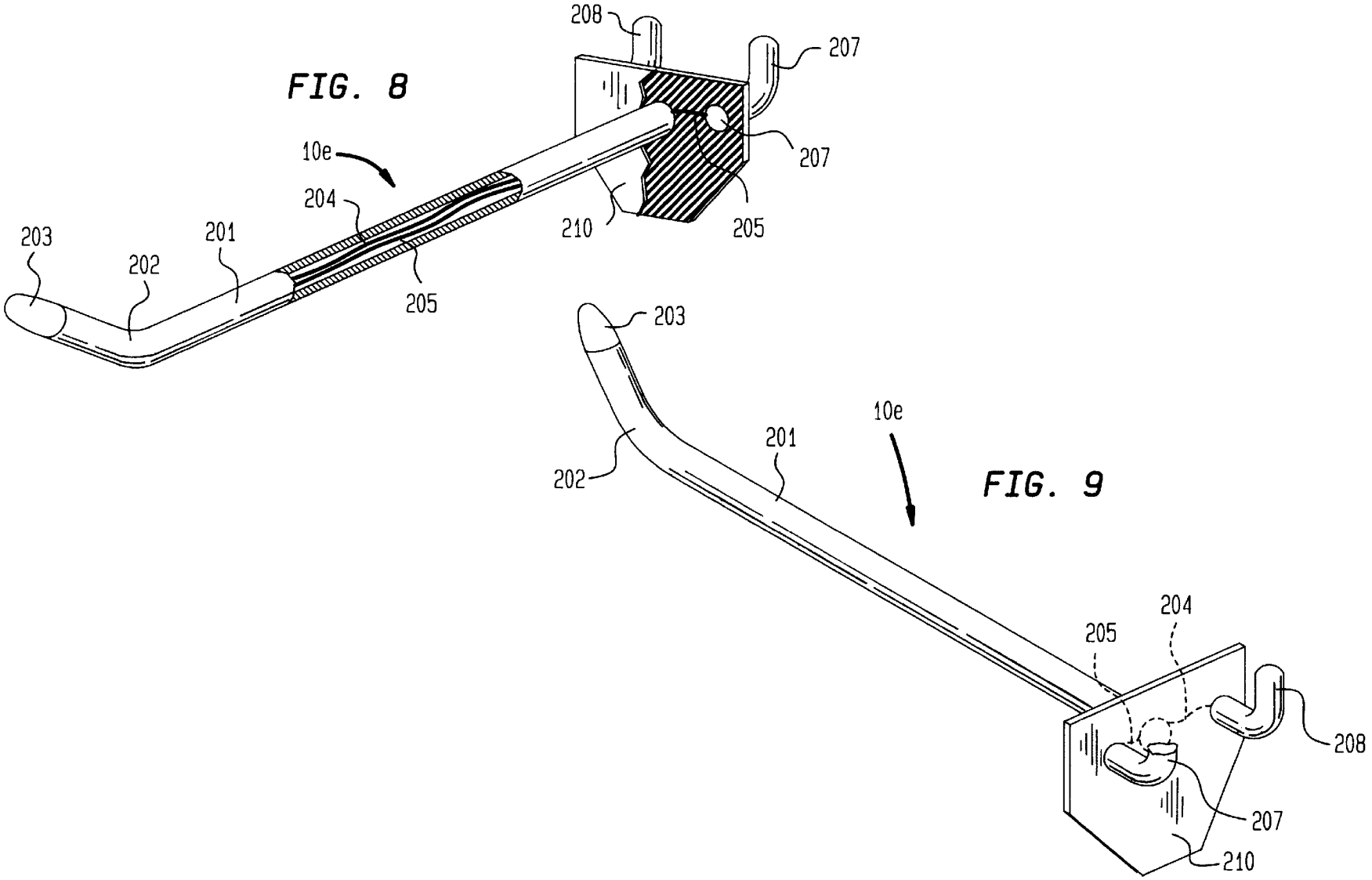
FIG. 8 is a pictorial view of still another embodiment of the invention shown in partial cross section.
FIG. 9 is a rear view of the embodiment shown in FIG. 8.

Of course, those skilled in these arts will recognize that an illuminated hook could also be formed wherein the electronic circuit and power source are mounted remotely from the display hook, the primary objective simply being to bring light directly to the product location. A remotely powered illuminated hook 10*e* is illustrated in FIGS. 8–9.

Figure 11:
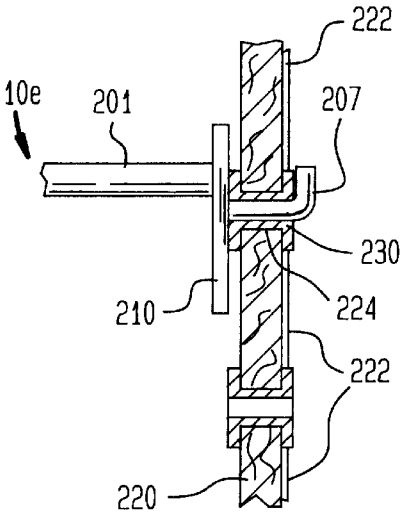
FIG. 11 is detail in section of a portion of the device shown in FIG. 10 having the display hook of FIGS. 8 and 9.
Figure 10:
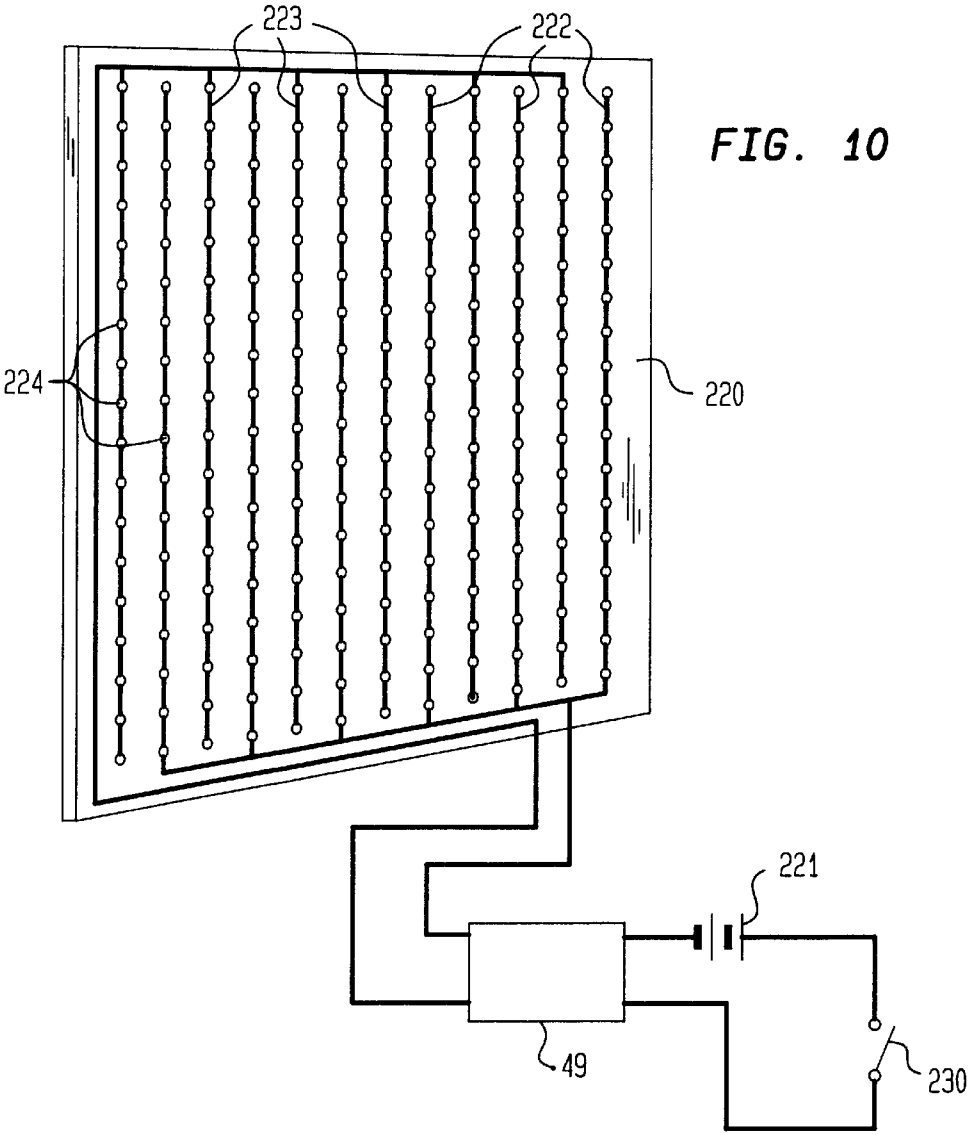
FIG. 10 is a diagrammatic view of a board for use with the present invention.

The illuminated hook 10*e* is designed for use with the wired board 220 (FIGS. 10, 11). As seen in FIGS. 8 and 9, hook 10*e* includes a shaft 201 having a curved end 202 with a light source 203 mounted on its free end. A pair of conductors 204, 205 extend through the shaft 201 from the light source 203 to the conductive curved studs 207, 208 via a flat insulated base 210 to which the shaft 201 is fixed. The conductors 204, 205, shown as conventional wires, may also be fabricated using printed circuit techniques. For example, the shaft 201 may be made from several laminations of insulating material one of which could have the conductors 204, 205 printed thereon. Likewise, the base 210 is illustrated as having laminated layers of insulating material in which the conductors 204, 205 are embedded. Conductor 205 is joined with one end of the conductive stud 207. A similar connection is employed for stud 208 and conductor 204.

FIG. 10 schematically shows the back of the wired perforated board 220. A low voltage DC power source such as battery 221 is connected, via on-off switch 230 and electronic package 49, to interleaved rows of conductors 222 and 223 that are wired to alternate rows of apertures 224. As such, the voltage supply is connected across horizontally adjacent apertures 224.

FIG. 11 illustrates details of the board 220 showing the aperture 224 and its related structure. Board 220 has a metallic grommet 230 that passes through each of the apertures 224. The grommets 230 are in electrical contact with the surface-mounted conductors 222. The metallic studs 207, 208 pass through adjacent grommets 230 to mount the display hook 10*e* in the customary fashion. The grommets 230 will also make conductive contact with the studs 207, 208 to supply electrical power to the light source 203 via conductors 204, 205.

It should be understood, of course, that the foregoing disclosure relates to only preferred embodiments of the invention and that numerous modifications or alterations may be made therein without departing from the spirit and the scope of the invention as set forth in the appended claims.

I claim:

1. An illuminated display apparatus for attachment to a perforated board panel having evenly spaced apertures for receiving studs, said apparatus comprising:

a base;

a thin, elongated first shaft having a first end attached to said base and a second end, wherein said second end of said first shaft is curved upwardly to form a hook means for retaining articles hung on said first shaft;

mounting means on said base for selective engagement with said perforated board panel for mounting said illuminated display apparatus with said first shaft in a substantially horizontal position, wherein said mounting means includes at least two curved studs protruding from said base for engagement with said evenly spaced apertures in said perforated board panel;

a light located near said second end of said first shaft;

conductor means connected to said light for providing electrical power to said light;

a second shaft extending from said base;

a housing means for mounting said light and said conductor means on said second shaft; and, a source of electrical power mounted in said housing means and connected to said conductor means, wherein said illuminated display apparatus may be randomly positioned on said perforated board panel by selectively engaging said studs in said evenly spaced apertures in said perforated board panel.

2. The apparatus of claim 1 further including a mounting plate attached to said second arm and wherein said housing means is attached to said plate.

3. The apparatus of claim 2 wherein said housing means is cylindrically shaped.

4. The apparatus of claim 3 wherein said housing means is joined to said second shaft with clips.

5. The apparatus of claim 3 wherein said housing means has a slot into which said second shaft extends.

* * * * *